US006453873B1

(12) United States Patent
Funke et al.

(10) Patent No.: US 6,453,873 B1
(45) Date of Patent: Sep. 24, 2002

(54) ELECTRO-HYDRAULIC COMPRESSION RELEASE BRAKE

(75) Inventors: Steven J. Funke, Princeville; Scott A. Leman, Eureka; Joshua C. Ruedin, Peoria, all of IL (US); Matthew G. Mickiewicz, Clayton, NC (US); Sameer Bhargava, Canton, MI (US)

(73) Assignee: Caterpillar Inc, Peoria, IL (US)

( * ) Notice: Subject to any disclaimer, the term of this patent is extended or adjusted under 35 U.S.C. 154(b) by 29 days.

(21) Appl. No.: 09/705,074

(22) Filed: Nov. 2, 2000

(51) Int. Cl.[7] ..... F02D 13/04
(52) U.S. Cl. ..... 123/322; 477/185
(58) Field of Search ..... 123/320–323; 477/185

(56) References Cited

U.S. PATENT DOCUMENTS

| | | | | |
|---|---|---|---|---|
| 3,220,392 A | | 11/1965 | Cummins | |
| 3,254,743 A | | 6/1966 | Finger | |
| 4,355,605 A | * | 10/1982 | Robinson et al. | 123/320 |
| 4,572,114 A | | 2/1986 | Sickler | |
| 4,688,384 A | | 8/1987 | Pearman et al. | |
| 4,794,890 A | | 1/1989 | Richeson, Jr. | |
| 5,012,778 A | | 5/1991 | Pitzi | |
| 5,121,723 A | | 6/1992 | Stepper et al. | |
| 5,127,375 A | | 7/1992 | Bowman et al. | |
| 5,193,657 A | | 3/1993 | Iizuka | |
| 5,255,650 A | | 10/1993 | Faletti et al. | |
| 5,357,926 A | | 10/1994 | Hu | |
| 5,379,737 A | | 1/1995 | Hu | |
| 5,479,890 A | * | 1/1996 | Hu et al. | 123/322 |
| 5,540,201 A | * | 7/1996 | Feucht et al. | 123/320 |
| 5,615,653 A | | 4/1997 | Faletti et al. | |
| 5,718,199 A | * | 2/1998 | Hu et al. | 123/322 |
| 5,967,115 A | * | 10/1999 | Konopka et al. | 123/322 |

FOREIGN PATENT DOCUMENTS

| | | |
|---|---|---|
| DE | 2151331 | 10/1971 |
| WO | WO 91/03630 | 3/1991 |

* cited by examiner

*Primary Examiner*—Gene Mancene
*Assistant Examiner*—Arnold Castro
(74) *Attorney, Agent, or Firm*—Steven W Weinrieb

(57) ABSTRACT

A system and method for controlling combustion engine compression braking having the variable timing of the dwell period of at least one exhaust valve by an electronic control module within each one of the engine cylinders during a braking event as well as the variable timing of the commencement or onset of the braking event. The system and method thus facilitate the proper performance of the braking event as a function of engine speed and prevents interference or physical impact with the cam driving elements used for achieving the normal or regular exhaust valve event.

17 Claims, 2 Drawing Sheets

ELECTRO-HYDRAULIC COMPRESSION RELEASE BRAKE

TECHNICAL FIELD

The present invention relates generally to engine compression release brakes, and more particularly to a system and a method of operating an engine compression release brake.

BACKGROUND ART

Vehicle engine compression brakes are conventionally used to assist and supplement wheel brakes when it is desired, for example, to slow heavy vehicles, such as, tractor-trailer trucks. Engine compression brakes are desirable because they help alleviate overheating of the wheel brakes. Engine compression brakes effectively convert an internal combustion engine from a power generating unit to a power consuming air compressor. In engine compression braking systems, it is known that the later the exhaust valve is opened during the compression stroke of the engine cycle, that is, as the piston is disposed closer or closest to the top-dead-center (TDC) position, the more retarding horsepower or braking will be generated or produced. Conversely, the sooner or earlier the exhaust valve is opened during the compression stroke of the engine cycle, that is, as the piston is disposed closer or closest to the bottom-dead-center (BDC) position, the less retarding horsepower or braking will be generated or produced. When maximum engine compression braking is desired, the timed opening of the engine compression brake exhaust valve is such that the engine compression brake exhaust valve undergoes or experiences maximum lift at approximately the top-dead-center (TDC) position of the cylinder piston.

In connection with vehicle engine compression braking schemes, systems, or methods of operating the same, an additional consideration to be taken into account is the duration of the valve dwell of the compression released braking event, that is, the amount of time that the engine compression release exhaust valve is maintained in its opened position. While it has been determined through analysis of various simulations, testing, and the like, that the amount or duration of the valve dwell does not significantly impact upon or influence the amount or level of engine compression braking achieved, the amount or duration of the valve dwell does significantly impact upon or influence the time required to close the compression release exhaust valve and the velocity at which the compression release exhaust valve moves toward its valve seat.

More particularly, the pressure within the cylinder affects the exhaust valve closing time and the velocity at which the exhaust valve seats upon its valve seat. Accordingly, the sooner you close the exhaust valve after the top-dead-center (TDC) position, the higher the pressure within the cylinder and therefore the faster the exhaust valve closes and the greater the velocity at which the exhaust valve seats. If the exhaust valve closes too rapidly, that is, if its seating velocity is too high, damage to the exhaust valve and/or its valve seat can occur. Consequently, a need exists in the art for an engine compression braking or release system, and a method of operating the same, wherein the exhaust valves of the engine cylinders can be activated or energized in various trade-off dwell time modes of operation so as to achieve, on the one hand, the engine exhaust valves must also achieve proper closure time periods and seating velocities.

A still further consideration to be taken into account in connection with vehicle engine compression braking schemes, systems, or methods of operating the same, is the fact that the exhaust valves of the engine also undergo regular or normal cam-driven-exhaust events, and that the compression release or braking event must be conducted or performed, in effect, independently of the normal or regular cam-driven exhaust event such that high velocity impact or interference between the operating or control cam for the normal or regular exhaust event, and the exhaust valve undergoing a compression braking or release event, does not occur, thereby preventing the generation of undesirable noise and potential damage to the engine components. A need therefore exists in the art for an engine compression release or braking system, and a method of operating the same, wherein the dwell of the engine compression release or braking exhaust valve can be appropriately controlled so as to achieve the engine compression or braking mode of operation while avoiding any high velocity interference with or impact upon the normal or regular exhaust valve event driving cam so as to prevent the generation of undesirable noise and potential damage to the engine components.

On such system is disclosed in U.S. Pat. No. 5,357,926 issued on Oct. 25, 1994 to Haoran Hu. In this patent the lash of the engine brake is adjusted to have a clearance between an engine brake slave piston and the engine exhaust valve mechanism. Thus, noise is reduced.

The present invention is directed to overcome one or more of the problems as set forth above.

DISCLOSURE OF THE INVENTION

In one aspect of the invention a method of achieving a compression braking event within an engine which normally has a cam driven exhaust valve event has the steps of providing at least one exhaust valve, having a valve seat, within each one of a plurality of cylinders of a combustion engine, wherein each one of the plurality of cylinders has a piston respectively disposed therein, and wherein the at least one exhaust valve undergoes a crank angle based braking event having a predetermined dwell period, and a crank angle based, cam driven regular exhaust valve event, connecting an electronic control module to each one of the plurality of engine cylinders such that the electronic control module can respectively activate each one of the at least one exhaust valve disposed within each one of the plurality of engine cylinders for performance of the braking event, and programming the electronic control module so as to respectively activate each one of the at least one exhaust valve disposed within each one of the plurality of engine cylinders at a predetermine time during a compression stroke of each one of said pistons respectively disposed within the plurality of cylinders and thereby achieve the braking event, and to variably adjust the dwell period of each one of the at least one exhaust valve as a function of engine speed so as to ensure completion of the braking event prior to commencement of the cam driving regular exhaust valve event.

In another aspect of the invention a system for achieving a compression braking event with an engine which normally has a cam driven exhaust valve event has at least one exhaust valve, having a valve seat, within each one of a plurality of cylinders of a combustion engine, wherein each one of the plurality of cylinders has a piston respectively disposed therein, and wherein the at least one exhaust valve undergoes a crank angle based braking event having a predetermined dwell period, and a crank angle based, cam driven regular exhaust valve event, and an electronic control module is connected to each one of the at least one exhaust valve disposed within each one of said plurality of engine cylinders and is predeterminedly programmed such that said electronic control module can respectively activate each one of the at least one exhaust valve disposed within each one of the plurality of engine cylinders at a predetermined time during a compression stroke of each one of the pistons respectively disposed within the plurality of cylinders and thereby perform the braking event, and to variably adjust the dwell period of each one of the at least one exhaust valve as a function of engine speed so as to ensure completion of the braking event prior to commencement of the cam-driven regular exhaust valve event.

BEST MODE FOR CARRYING OUT THE INVENTION

Figure 1:
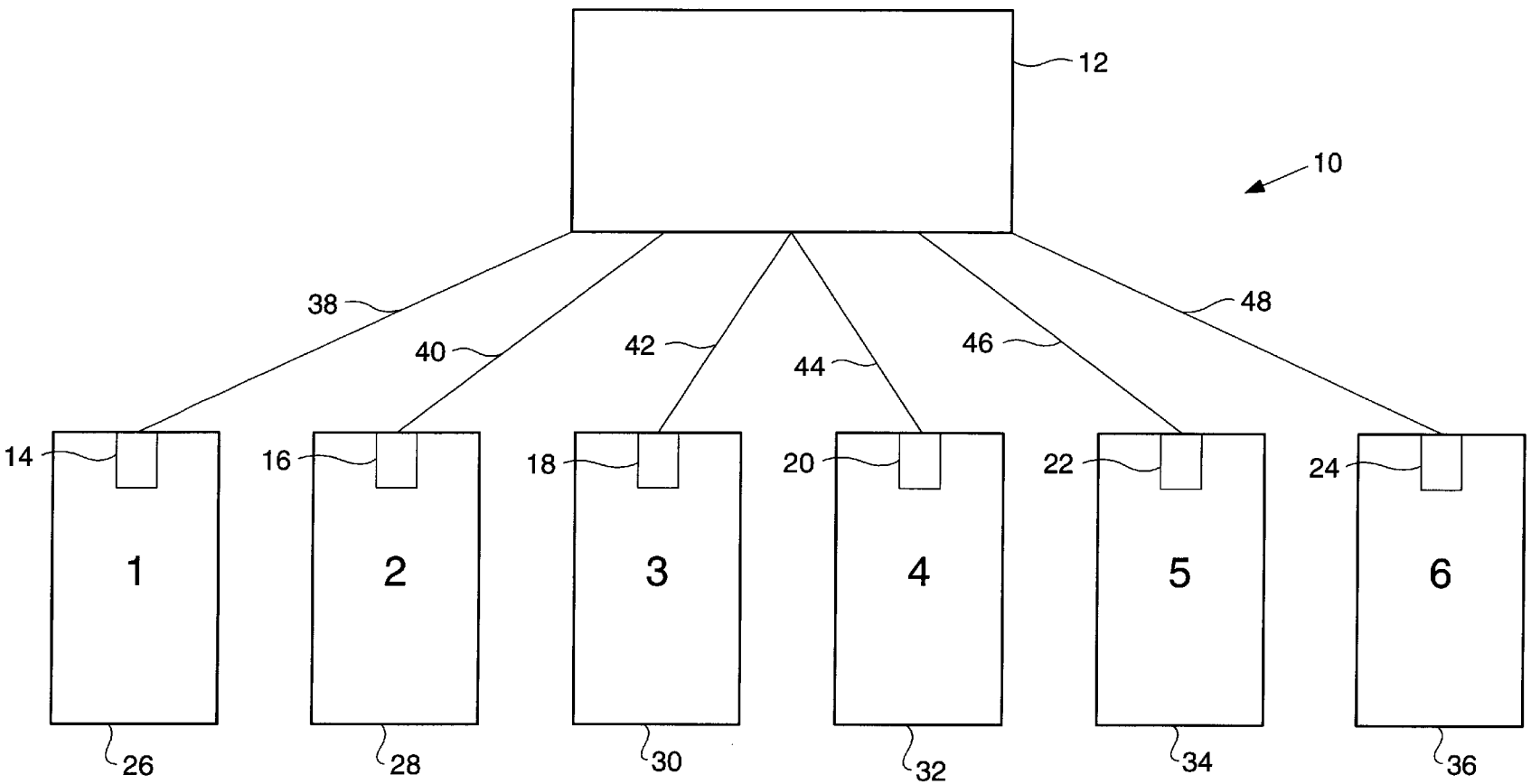
FIG. 1 is a schematic view of a control system for an engine.

Referring to FIG. 1, a control system for a six-cylinder engine is schematically disclosed and is generally indicated by the reference character 10. The control system 10 has an electronic control module (ECM) 12, and the electronic control module 12 is operatively connected to each one of a plurality of exhaust valves 14–24. The plurality of exhaust valves 14–24 are respectively disposed within each one of the engine cylinders 26–36. The electronic control module 12 can control the timing of the opening of each one of the exhaust valves 14–24 through well-known mechanisms, such as, for example, electrical, or electro-hydraulic solenoid-drives 38–48.

Figure 2:
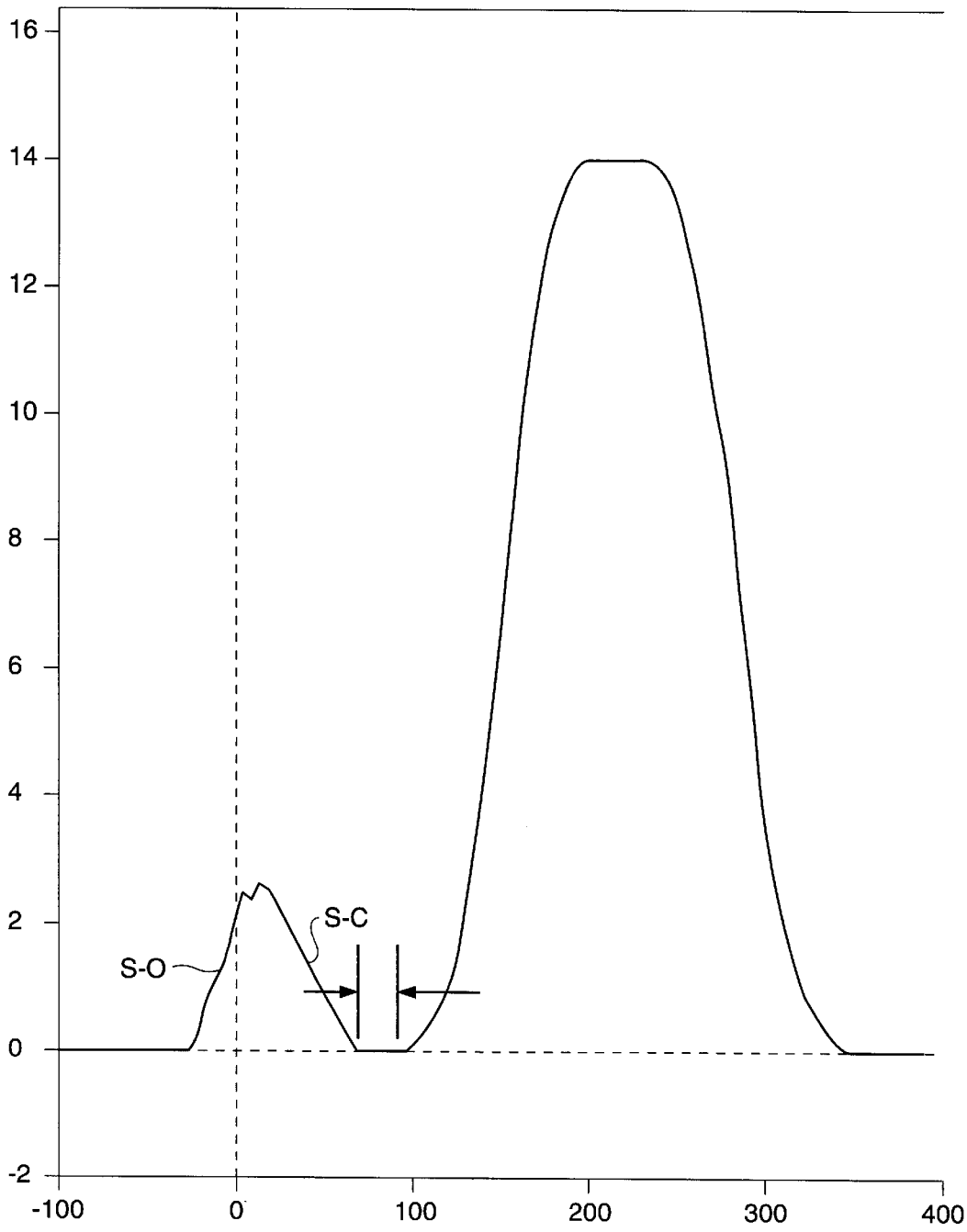
FIG. 2 is a graph showing crank angle, in connection with both the regular exhaust valve event and the compression release or braking event.

With reference to FIG. 2, there is illustrated a graph illustrating exhaust valve lift as a function of engine crank angle. The opening, closing, and dwell duration periods of the exhaust valves are controlled during both engine compression release or braking events and normal or regular exhaust valve events. It is to be understood that the electronic control module 12 of FIG. 1 controls the exhaust valves 14–24 during the engine compression release or braking events while the exhaust valves 14–24 are cam controlled in a conventional manner, by conventional cam driven mechanisms, not shown, during the regular or normal exhaust valve events.

It is further noted that since the vertical or y-axis of the graph is depicting exhaust valve lift, the exhaust valves are illustrated as being in their closed or seated positions or states at an exhaust valve lift level of zero both during the engine compression braking and regular or normal exhaust valve events. In addition, as the horizontal or x-axis of the graph is depicting the engine crank angle in degrees, the top-dead-center (TDC) position of the crankshaft at the end of the piston compression stroke is noted at 0°. The bottom-dead-center (BDC) position of the crankshaft at the end of the piston power stroke is noted at 180°. And, the top-dead-center (TDC) position of the crankshaft at the end of the piston exhaust stroke is noted at 360°.

Still further, it is noted that the engine compression braking event is commenced when the crankshaft is at an angular position of approximately 30° before compression top-dead-center (CTDC). And, the maximum exhaust valve lift is achieved during the engine compression braking event when the crankshaft is disposed at an angular position approximately coinciding with compression top-dead-center (CTDC). Similarly, the regular or normal exhaust valve event is commenced when the crankshaft is at an angular position of approximately 100° after compression top-dead-center (CTDC). This is also equivalent to an angular position of approximately 80° before power bottom-dead-center (PBDC), that is, the normal or regular exhaust valve event. The exhaust valves are caused to commence their opening by their cam controlled mechanisms, is commenced during performance of the piston power stroke and before commencement of the piston exhaust stroke.

It is therefore imperative that in order to prevent any interference or physical impact between the opened exhaust valve during performance of the engine compression braking event, and the cam mechanism for controlling the exhaust valve during the regular or normal exhaust valve event, that the engine compression braking event be completed before commencement of the regular or normal exhaust valve event. In other words, there must be provided a sufficiently long period of time subsequent to the completion of the engine compression braking event, and prior to the commencement of the regular exhaust valve event, for the exhaust valve to be fully closed and seated before again being opened by the cam driven mechanisms such that the aforenoted interference or physical impact between the exhaust valve and the cam-driven mechanisms does not occur. This is graphically illustrated by the pre-regular exhaust valve event (PREVE) time period which occurs at approximately 80° after the compression top-dead-center (CTDC) position and lasts until approximately 100° after compression top-dead-center (CTDC) at which time the regular exhaust valve event commences as has been noted hereinbefore.

With reference continuing to be made to the graph of FIG. 2, the dwell period of the exhaust valve is maintained in its maximum open or valve lift position. It is also noted as occurring at or approximately coinciding with the compression top-dead-center (CTDC) position, during performance of an engine compression braking event. It has been determined, however, that as engine speed increases, the real time available for closing the engine compression exhaust valve during, for example, performance of its braking event, decreases substantially. For example, if the exhaust valve is to be completely closed within 100° after compression top-dead-center (CTDC), then the real time period for achieving such closure is 9.26 msec at an engine speed of 1800 RPM, however, the real time period for achieving such closure at an engine speed of 3300 RPM is only 5.05. Accordingly, the entire engine compression braking event, including the opening, closing, and dwell time periods for the exhaust valve must be adjusted in a real-time based manner so as to again ensure that the braking event is completed sufficiently before commencement of the regular exhaust valve event.

As has been noted hereinbefore, it must be remembered that the angular cycle time at which the braking event is commenced by opening the engine compression release exhaust valve, that is, for example, at 20° before compression top-dead-center (CTDC), will influence or impact upon the real time or rapidity required to open the compression release exhaust valve during the compression stroke, and this real-time-period or duration is graphically illustrated in FIG. 2 by the slope of the braking event graphical plot labeled S-O which indicates the slope of the event for the opening phase thereof. In a similar manner, it is also to be remembered that the amount or duration of the valve dwell significantly impact upon or influences the real time required to close the compression release exhaust valve and the velocity at which the compression release exhaust valve moves toward its valve seat.

More particularly, the valve dwell duration also determines in part the pressure within the cylinder. The sooner the exhaust valve is closed after the compression top-dead-center (CTDC) position, the higher the pressure remaining within the cylinder and therefore the faster the exhaust valve will close and the greater the velocity at which the exhaust valve will seat. Therefore, if the exhaust valve is closed too soon after compression top-dead-center (CTDC), that is, the dwell period is too short, the pressure within the cylinder remains high and the exhaust valve will close rapidly. However, the valve seating velocity is also high which can potentially damage the exhaust valve and/or its valve seat. This real-time period or duration for closure of the exhaust valve during the braking event is graphically illustrated in FIG. 2 by the slope of the braking event graphical plot labeled S-C which indicates the slope of the event for the closing phase thereof. On the other hand, if the dwell period is too long, the real-time period for closure of the exhaust valve will be extended, the pre-regular exhaust valve event (PREVE) period will have been effectively eliminated and interference with the cam driven engine components for achieving the:regular exhaust valve event may occur.

INDUSTRIAL APPLICABILITY

In accordance with the principles and teachings of the present invention, the electronic control module 12 can be pre-programmed so as to vary the dwell period or duration as a function of, for example, engine crank angle and/or vehicle compression engine braking event is ensured to be completed prior to the commencement of the cam controlled regular exhaust valve event so as to avoid any interference or physical impact with the cam driven control mechanisms for achieving the regular exhaust valve event. Simulations and tests have shown, for example, that when the exhaust valve is closed 20° after compression top-dead-center (CTDC), the valve is closed 20° after compression top-dead-center (CTDC), the valve closing time is approximately twice as long as the closing time required for. the valve when the valve is closed at compression top-dead-center (CTDC). In a similar manner, the time at which the braking event is commenced, that is, in terms of engine crank angle, also determines the rapidity at which the compression braking exhaust valve opens to its full extent during the braking event, and consequently, such commencement time can also be suitably controlled by the electronic control module 12 along with the aforenoted control of the dwell period duration.

It is also to be remembered that as engine speed increases, the real time available for achieving closure of the engine compression release or braking exhaust valve drastically decreases. Thus, it may be readily appreciated that both the commencement or onset of the braking event, as well as the duration or dwell of the braking event, can be suitably controlled by the electronic control module which activates or energizes the compression release brake valve at suitable times of the braking event both from an engine crankshaft angle base reference as well as a real-time-base reference.

It is to be noted that when altering or adjusting the pre-programmed modes of the electronic control module 12 so as to in turn energize or activate the compression release brake exhaust valve at the predetermined times of the braking event cycle, trade-offs in achieved results will be experienced or achieved. For example, in order to achieve completion of the braking event prior to the commencement or onset of the regular exhaust valve event, the dwell time or duration may have to be shortened if engine speed is substantially high, however, the cylinder pressures may then be somewhat high or relatively elevated which may then lead to rapid closure of the exhaust valve with relatively high seating velocities. Conversely, the dwell time or duration can be somewhat lengthened so as to permit additional cylinder pressure to exhaust whereby the exhaust valve closes somewhat more slowly and the substantially high impact forces of the exhaust valve upon its valve seat are somewhat alleviated, it nevertheless being ensured that sufficient time is still provided for completion of the braking event prior to commencement or onset of the regular exhaust valve event.

While the use of an electronic control module to control the opening and closing of an engine compression release or braking exhaust valve within and engine is known, and therefore will not be discussed in detail herein, what is submitted to be new and novel is the use of an electronic control module to control the timing of the opening, closing, and dwell duration of the engine compression release or braking exhaust valves as a function of engine speed by varying the dwell time or opened duration of the exhaust valves of the engine cylinders at different predetermined times of the compression and power strokes of each piston within each cylinder such that the engine compression release or braking events can be achieved without interference with the cam control elements or components operatively associated with the normal or regular exhaust valve events.

Obviously, many variations and modification of the present invention are possible in light of the above teachings. It is therefore to be understood that within the scope of the appended claims, the present invention may be practiced otherwise than as specifically described herein.

What is claimed is:

1. Method of achieving a compression braking event within a combustion engine which normally has a cam driven exhaust valve event, comprising the steps of:

providing at least one exhaust valve, having a valve seat, within each one of a plurality of cylinders of a combustion engine, wherein each one of said plurality of cylinders has a piston respectively disposed therein, and wherein said at least one exhaust valve undergoes a crank angle based braking event having a predetermined dwell period, and a crank angle based, cam driven regular exhaust valve event;

connecting an electronic control module to each one of said at least one exhaust valve disposed within each one of said plurality of engine cylinders such that said electronic control module can respectively activate said each one of said at least one exhaust valve disposed within said each one of said plurality of engine cylinders for performance of said braking event; and programming said electronic control module so as to respectively activate said each one of said at least one exhaust valve disposed within said each one of said plurality of engine cylinders at a predetermined time during a compression stroke of each one of said pistons respectively disposed within said plurality of cylinders and thereby achieve said braking event, and to variably adjust said dwell period of said each one of said at least one exhaust valve as a function of engine speed so as to ensure completion of said braking event prior to commencement of said cam driven regular exhaust valve event, said electronic control module being programmed so as to respectively activate said each one of said at least one exhaust valve disposed within, said each one of said plurality of engine cylinders at a predetermined time during said compression stroke of each one of said pistons respectively disposed within said plurality of cylinders, said predetermined dwell time period being progressively shortened as said engine speed increases.

2. The method as set forth in claim 1, wherein said electronic control module is programmed so as to respectively activate said each one of said at least one exhaust valve disposed within said each one of said at least one exhaust valve disposed within said each one of said plurality of engine cylinders at a predetermined latest time during said compression stroke of each one of said pistons respectively disposed within said plurality of cylinders wherein said latest time includes a time of approximately 30° before compression top-dead-center.

3. The method as set forth in claim 1, wherein said electronic control module is programmed so as to respectively activate said each one of said at least one exhaust valve disposed within said each one of said plurality of engine cylinders at a predetermined earliest time during said compression stroke of each one of said pistons respectively disposed within said plurality of cylinders wherein said dwell period includes an angular camshaft extent of 20°.

4. The method as set forth in claim 3, wherein said electronic control module is programmed so as to respectively activate said each one of said at least one exhaust valve disposed within said each one of said plurality of engine cylinders wherein said dwell period commences at a camshaft angular position which substantially coincides with compression top-dead-center.

5. The method as set forth in claim 1, wherein said electronic control module is programmed so as to respectively activate said each one of said at least one exhaust valve disposed within said each one of said plurality of engine cylinders at predetermined time during said compression stroke of each one of said pistons respectively disposed within said plurality of cylinders wherein said predetermined dwell time period is sufficiently long so as to permit a sufficient amount of compression pressure to escape from each one of said plurality of cylinders such that said at least one exhaust valve does not impact upon its valve seat with an inordinately high amount of impact force so as to prevent damage to said exhaust valve and said valve seat.

6. A system for achieving a compression braking event within a combustion engine which normally has a cam driven exhaust valve event, comprising:

at least one exhaust valve, having a valve seat, within each one of a plurality of cylinders of a combustion engine, wherein each one of said plurality of cylinders has a piston respectively disposed therein, and wherein said at least one exhaust valve undergoes a crank angle based braking event having a predetermined dwell period, and a crank angle based, cam driven regular exhaust valve event; and an electronic control module connected to each one of said at least one exhaust valve disposed within each one of said plurality of engine cylinders and predeterminedly programmed such that said electronic control module can respectively activate said each one of said at least one exhaust valve disposed within said each one of said plurality of engine cylinders at a predetermined time during a compression stroke of each one of said pistons respectively disposed within said plurality of cylinders and thereby perform said braking event, and to variably adjust said dwell period of said each one of said at least one exhaust valve as a function of engine speed said variably adjusting of said dwell period insuring completion of said braking event prior to commencement of said cam-driven regular exhaust valve event.

7. The system as set forth in claim 6, wherein said electronic control module is programmed so as to respectively activate said each one of said at least one exhaust valve disposed within said each one of said plurality of engine cylinders at a predetermined latest time during said compression stroke of each one of said pistons respectively disposed within said plurality of cylinders wherein said latest time includes a time of 20° before compression top-dead-center.

8. The system as set forth in claim 6, wherein said electronic control module is programmed so as to respectively activate said each one of said at least one exhaust valve disposed within said each one of said plurality of engine cylinders at a predetermined earliest time during said compression stroke of each one of said pistons respectively disposed within said plurality of cylinders wherein said dwell period includes an angular camshaft extent of 20°.

9. The system as set forth in claim 8, wherein said electronic control module is programmed so as to respectively activate said each one of said at least on exhaust valve disposed within said each one of said plurality of engine cylinders wherein said dwell period commences at a camshaft angular position which substantially coincides with compression top-dead-center.

10. The system as set forth in claim 6, wherein said electronic control module is programmed so as to respectively activate said each one of said at least one exhaust valve disposed within said each one of said plurality of engine cylinders at a predetermined time during said compression stroke of each one of said pistons respectively disposed within said plurality of cylinders wherein said predetermined dwell time period is progressively shortened as said engine speed increases.

11. The system as set forth in claim 10, wherein said electronic control module is programmed so as to respectively activate said each one of said at least one exhaust valve disposed within said each one of said plurality of engine cylinders at a predetermined time during said compression stroke of each one of said pistons respectively disposed within said plurality of cylinders wherein said predetermined dwell time period is sufficiently long so as to permit a sufficient amount of compression pressure to escape from each one of said plurality of cylinders such that said at least one exhaust valve does not impact upon its valve seat with an inordinately high amount of impact force so as to prevent damage to said exhaust valve and said valve seat.

12. An internal combustion engine having a plurality of cylinders, a plurality of exhaust valves each of said plurality of exhaust valves and being actuated by a cam during a normal event of said internal combustion engine, and each of said plurality of exhaust valves defining a crank angle based, cam driven regular exhaust valve event of said internal combustion engine; said internal combustion engine comprising;

an electro-hydraulic solenoid driver being connected to a respective one of said cam driven exhaust valve achieving a compression braking event within said internal combustion engine which normally has a cam driven exhaust valve event;

at least one exhaust valve, having a valve seat, within each one of a plurality of cylinders of said internal combustion engine;

said each one of said plurality of cylinders having a piston respectively disposed therein;

said at least one exhaust valve undergoing a crank angle based braking event having a predetermined dwell period;

an electronic control module being connected to said internal combustion engine to each one of said at least one exhaust valve disposed within each one of said plurality of engine cylinders such that said electronic control module can respectively activate said each one of said at least one exhaust valve disposed within said each one of said plurality of engine cylinders for performance of said braking event; and a program being operatively connected to said electronic control module to activate said electronic control module so as to respectively activate said each one of said at least one exhaust valve disposed within said each one of said plurality of engine cylinders at a predetermined time during a compression stroke of each one of said pistons respectively disposed within said plurality of cylinders and thereby achieve said braking event, and to variably adjust said dwell period of said each one of said at least one exhaust valve as a function of engine speed said variably adjusting of said dwell period insuring completion of said braking event prior to commencement of said cam driven regular exhaust valve event.

13. The internal combustion engine as set forth in claim 12, wherein said program activates said electronic control module so as to respectively activate said each one of said at least one exhaust valve disposed within said each one of said at least one exhaust valve disposed within said each one of said plurality of engine cylinders at a predetermined latest time during said compression stroke of each one of said pistons respectively disposed within said plurality of cylinders wherein said latest time includes a time of approximately 30° before compression top-dead-center.

14. The internal combustion engine as set forth in claim 12, wherein said program activates said electronic control module so as to respectively activate said each one of said at least one exhaust valve disposed within said each one of said plurality of engine cylinders at a predetermined earliest time during said compression stroke of each one of said pistons respectively disposed within said plurality of cylinders wherein said dwell period includes an angular camshaft extent of 20°.

15. The internal combustion engine as set forth in claim 14, wherein said program activates said electronic control module so as to respectively activate said each one of said at least one exhaust valve disposed within said each one of said plurality of engine cylinders wherein said dwell period commences at a camshaft angular position which substantially coincides with compression top-dead-center.

16. The internal combustion engine as set forth in claim 12 wherein said program activates said electronic control module so as to respectively activate said each one of said at least one exhaust valve disposed within said each on of said plurality of engine cylinders at a predetermined time during said compression stroke of each on of said pistons respectively disposed within said plurality of cylinders wherein said predetermined dwell time period is progressively shortened as said engine speed increases.

17. The internal combustion engine as set forth in claim 16, wherein said program activates said electronic control module so as to respectively activate said each one of said at least one exhaust valve disposed within said each one of said plurality of engine cylinders at predetermined time during said compression stroke of each one of said pistons respectively disposed within said plurality of cylinders wherein said predetermined dwell time period is sufficiently long so as to permit a sufficient amount of compression pressure to escape from each one of said plurality of cylinders such that said at least one exhaust valve does not impact upon its valve seat with an inordinately high amount of impact force so as to prevent damage to said exhaust valve and said valve seat.

* * * * *

UNITED STATES PATENT AND TRADEMARK OFFICE

CERTIFICATE OF CORRECTION

PATENT NO. : 6,453,873 B1
DATED : September 24, 2002
INVENTOR(S) : Sameer Bhargava et al.

It is certified that error appears in the above-identified patent and that said Letters Patent is hereby corrected as shown below:

Column 6,
Line 35, delete "Method" and insert -- A method --.
Line 66, delete "," after the word "within".

Signed and Sealed this

Fourth Day of February, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,453,873 B1
DATED : September 24, 2002
INVENTOR(S) : Sameer Bhargava et al.

It is certified that error appears in the above-identified patent and that said Letters Patent is hereby corrected as shown below:

Column 6,
Line 35, delete "Method" and insert -- A method --.
Line 66, delete "," after the word "within".

Signed and Sealed this

Twenty-fifth Day of February, 2003

JAMES E. ROGAN
*Director of the United States Patent and Trademark Office*